US006126727A

United States Patent [19]

Lo

[11] Patent Number: 6,126,727

[45] Date of Patent: Oct. 3, 2000

[54] ELECTRODE PANEL-DRAWING DEVICE OF A STATIC ION DISCHARGER

[76] Inventor: Ching-Hsiang Lo, No. 104, Huah-Cherng Rd., Shin-Juang City, Taipei Hsien, Taiwan

[21] Appl. No.: 09/238,433

[22] Filed: Jan. 28, 1999

[51] Int. Cl.[7] ..... B03C 3/78

[52] U.S. Cl. ..... 96/39; 95/75; 96/44; 96/97

[58] Field of Search ..... 96/97, 94, 39–41, 96/44; 95/74, 75

[56] References Cited

U.S. PATENT DOCUMENTS

| | | | |
|---|---|---|---|
| 5,290,343 | 3/1994 | Morita et al. | 96/39 |
| 5,702,507 | 12/1997 | Wang | 96/97 X |
| 5,820,660 | 10/1998 | Ko | 96/97 X |

FOREIGN PATENT DOCUMENTS

| | | | |
|---|---|---|---|
| WO 87/00089 | 1/1987 | WIPO | 95/74 |

*Primary Examiner*—Richard L. Chiesa
*Attorney, Agent, or Firm*—Varndell & Varndell, PLLC

[57] ABSTRACT

An electrode panel-drawing device of a static ion discharger, including a box body. A top section of the box body is formed with an opening. A bottom section of the box body is disposed with a connecting seat. The box body is disposed with ventilators, an activating switch and an adjustment button. A motor, a fan and an AC-to-DC circuit board are disposed in the box body. A drawer body is fitted into the opening of the box body. The drawer body is disposed with discharge needles and electrode panels at equal intervals. The positive terminal of the circuit board is connected to the discharge needles, while the negative terminal of the circuit board is connected to the electrode panels. The positive discharge needles ionize the air to eliminate the static electricity. The drawer body can be drawn out of the box body for directly washing the discharge needles and the electrode panels.

3 Claims, 5 Drawing Sheets

ELECTRODE PANEL-DRAWING DEVICE OF A STATIC ION DISCHARGER

BACKGROUND OF THE INVENTION

The present invention relates to an electrode panel-drawing device of a static ion discharger, which can be drawn out for directly washing the discharge needles and the electrode panels. The device is applicable to those situations necessitating static elimination.

FIGS. 1*a* and 1*b* show a conventional static eliminator including a main body A and a support body B. The main body A is formed with rows of ventilators A1 in each of which is disposed a sharp needle A2. A fan A4 is mounted behind the sharp needle A2. Two electrode panels A3 are disposed on upper and lower sides of front end of the sharp needle A2. A movable slide button A11 is disposed at the center of the ventilator A1. An inner end of the slide button is equipped with a brush A12 contacting with the sharp needle A2.

The ions discharged by the sharp needle A2 connected to a DC high voltage are blown by the fan A4 out of the ventilators A1 so as to achieve a static eliminating effect. After a period of use, the discharge sharp needle A2 and the electrode panels A3 tend to attract the charged dust which will accumulate thereon. At this time, the slide button A11 can be slided left and right so that the brush A12 can brush the discharge sharp needle A2 and remove the dust attaches thereto. This measure can only clean up the dust attaching to the discharge needle A2, while failing to remove the dust accumulating on the electrode panels A3.

SUMMARY OF THE INVENTION

It is a primary object of the present invention to provide an electrode panel-drawing device of a static ion discharger, which can be conveniently used.

It is a further object of the present invention to provide the above electrode panel-drawing device of a static ion discharger, which can be drawn out for directly washing the discharge needles and the electrode panels.

According to the above objects, the electrode panel-drawing device of the present invention includes a box body. A top section of the box body is formed with an opening. A bottom section of the box body is disposed with a connecting seat. The box body is disposed with ventilators, an activating switch and an adjustment button. A motor, a fan and an AC-to-DC circuit board are disposed in the box body. A drawer body is fitted into the opening of the box body. The drawer body is disposed with discharge needles and electrode panels at equal intervals. The positive terminal of the circuit board is connected to the discharge needles, while the negative terminal of the circuit board is connected to the electrode panels. The positive discharge needles ionize the air to eliminate the static electricity. The drawer body can be drawn out of the box body for directly washing the discharge needles and the electrode panels.

The present invention can be best understood through the following description and accompanying drawings, wherein:

DETAILED DESCRIPTION OF THE PREFERRED EMBODIMENT

Figure 1A:
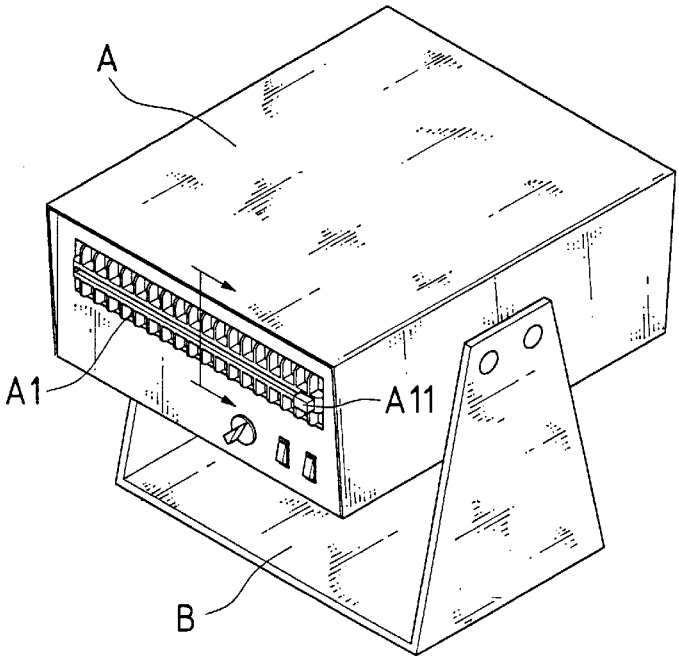
PRIOR ART FIG.1 A
FIG. 1*a* is a perspective assembled view of a conventional static eliminating device.
Figure 1B:
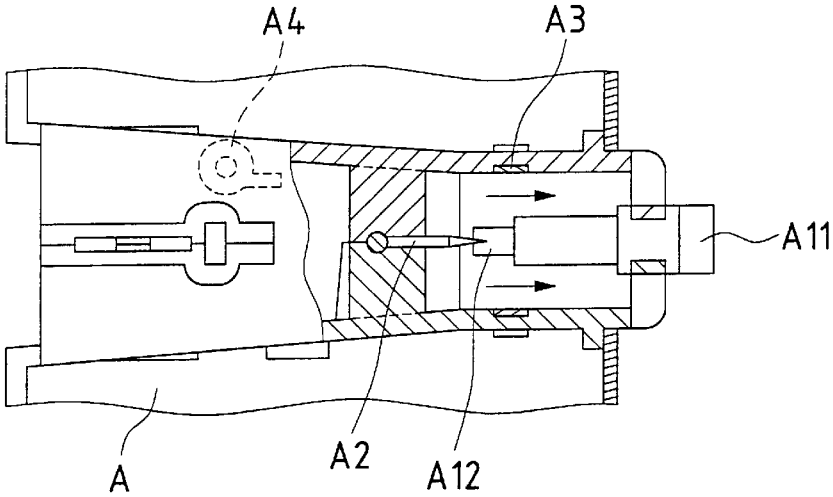
PRIOR ART FIG.1 B
FIG. 1*b* is a sectional view of the conventional static eliminating device.
Figure 2:
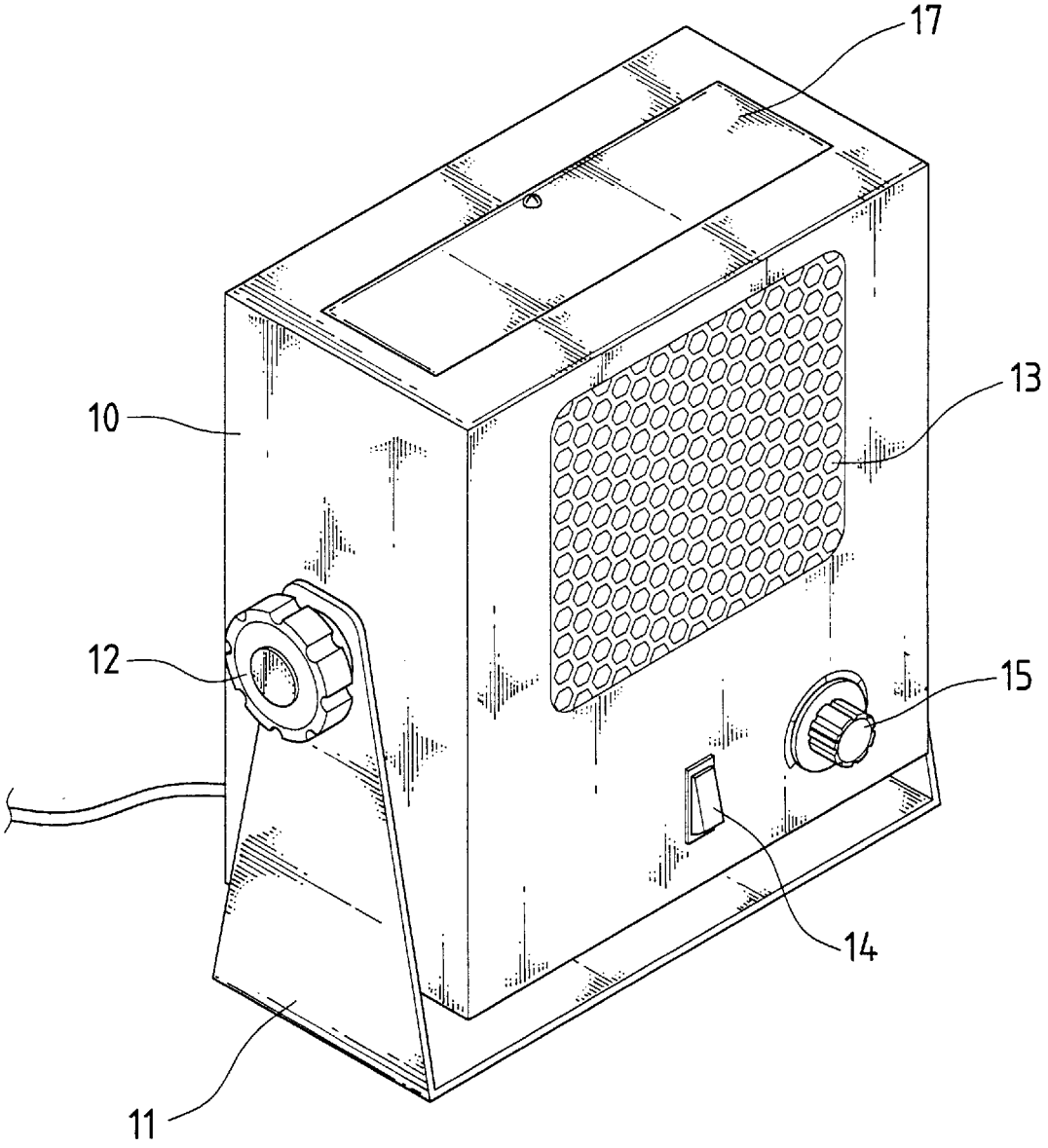
FIG. 2 is a perspective assembled view of the present invention.
Figure 3:
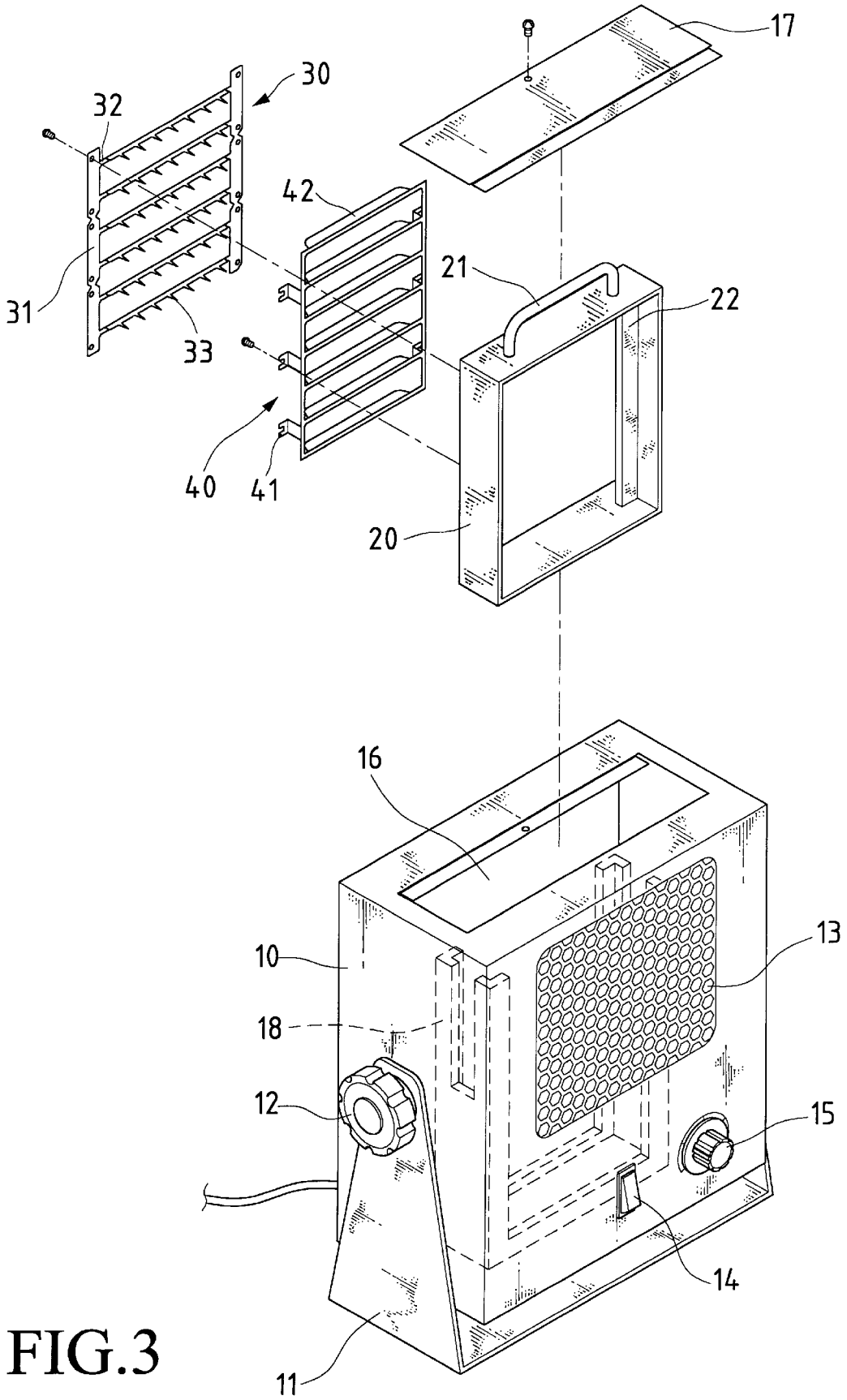
FIG. 3 is a perspective exploded view of the present invention.

Please refer to FIGS. 2 and 3. The electrode panel-drawing device of the present invention is substantially a box body 10 having a connecting seat 11.

A top section of the box body 10 is formed with an opening 16 connected with a box cover 17. The box body 10 is formed with an insertion channel 18 inward extending from the opening 16. An upper half portion of front face of the box body 10 is formed with multiple ventilators 13. A lower half portion of the box body 10 is disposed with an activating switch 14 and an adjustment button 15. The centers of two sides of the box body 10 are formed with shaft holes for a pivot shaft 12 to fit therein so as to pivotally connect the connecting seat 11 with the main body 10.

Figure 4:
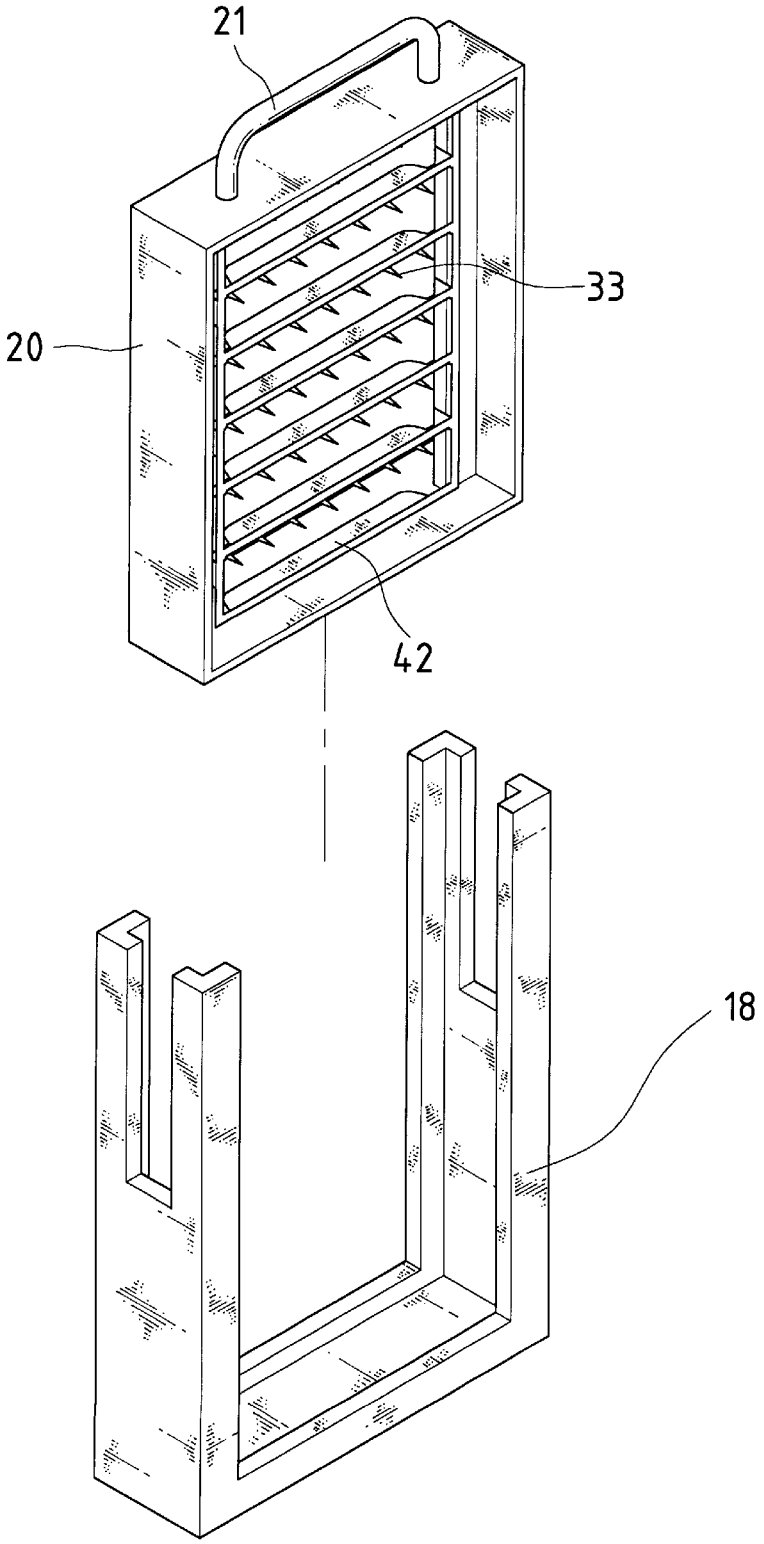
FIG. 4 is a perspective view of drawer body of the present invention.

Referring to FIGS. 3 and 4, a drawer body 20 is snugly drawably inserted into the insertion channel 18. A handle 21 is disposed on a top face of the drawer body 20. Two inner lateral sides of the drawer body 20 are respectively disposed with two inward projecting securing sections 22.

The discharge needle seat 30 is integrally made of a metal sheet. Two lateral sides of the discharge needle seat 30 are disposed with two securing sections 31 with a certain length. The securing sections 31 are formed with thread holes. Multiple transverse strips 32 are connected between two securing sections 31. A lower edge of each transverse strip 32 is forward 90 degrees bent. The bent section of the transverse strip 32 is disposed with discharge needles 33 at equal intervals.

The electrode panel seat 40 is made of plastic material by injection molding, having a form of a substantially rectangular frame body. A left and a right sides of the frame body are respectively disposed with spaced bent connecting sections 41. The frame body is disposed with internal transverse beams at equal intervals. A bottom edge of each transverse beam is connected with a perpendicularly projecting electrode panel 42.

Figure 5:
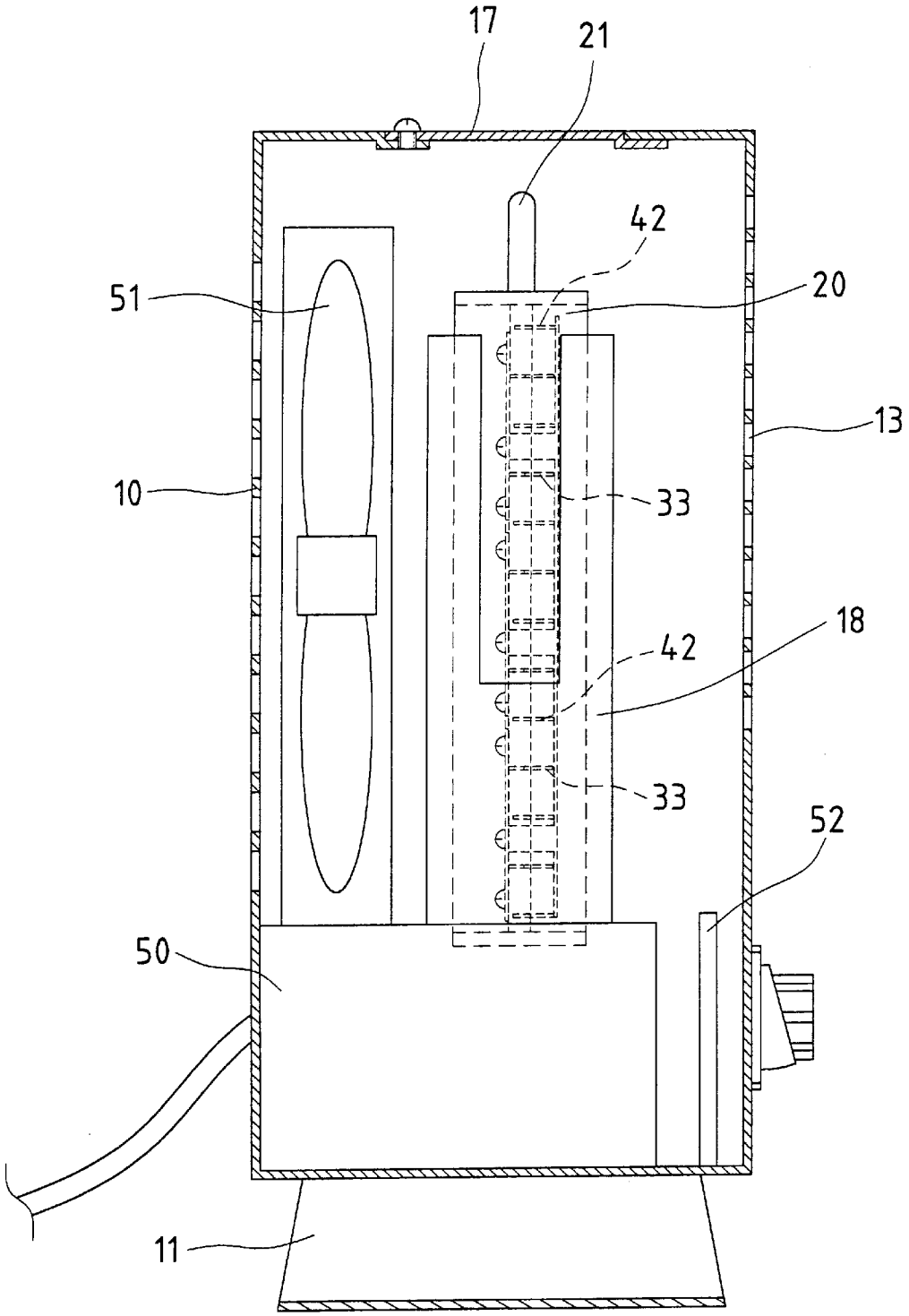
FIG. 5 is a sectional assembled view of the present invention.

Referring to FIG. 5, a motor 50, AC-to-DC circuit board 52 and a fan 51 are previously mounted in the box body 10. The fan 51 is positioned behind the ventilators 13. The securing sections 31 of two sides of the discharge needle seat 30 and the positive terminal 53 of the AC-to-DC circuit board 52 are together screwed with the outer side thread holes of the securing sections 22 of the drawer body 20. The electrode panel seat 40 and the negative terminal of the AC-to-DC circuit board 52 are together screwed with the inner side thread holes of the securing sections 22 of the drawer 20. Each row of discharge needles 33 are positioned between two electrode panels 42 (as shown in FIG. 4 ). The drawer 20 is fitted into the insertion channel 18 of the box body 10. Then the box cover 17 is secured to the opening 16 of the box body 10.

When the activating switch 14 is switched to an ON position, the positive terminal 53 of the AC-to-DC circuit board 52 provides high voltage DC current for the discharge needle seat 30. At this time, the intervals between each two transverse beams 32 are equal to each other so that the discharge ions generated by each discharge needle 33 can easily achieve an equilibrium to ionize the air. The fan 51 serves to blow out the ionized air to achieve a static eliminating effect. However, the air often entrains microparticles which are collided by the ionized air and charged. Therefore, the microparticles tend to attach to the electrode panels 42. After a period of use, the drawer body 20 can be drawn out for washing the electrode panels 42 (as shown in FIG. 4). Such procedure can be conveniently performed to achieve an accurate cleaning effect.

It should be noted that the above description and accompanying drawings are only used to illustrate one embodiment of the present invention, not intended to limit the scope thereof. Any modification of the embodiment should fall within the scope of the present invention.

What is claimed is:

1. An electrode panel-drawing device of a static ion discharger, comprising a box body, a top section of the box body being formed with an opening, a bottom section of the box body being disposed with a connecting seat, wherein:

the box body is disposed with ventilators, an activating switch and an adjustment button, a motor, a fan and an AC-to-DC circuit board being disposed in the box body, a box cover being secured to the opening of the top section of the box body;

a handle is mounted on the top section of a drawer body, two inner lateral sides of the drawer body being disposed with stepped securing sections;

a discharge needle seat is integrally made of a metal sheet, two lateral sides of the discharge needle seat being disposed with two securing sections, multiple transverse strips being connected between the securing sections, each transverse strip being disposed with discharge needles at equal intervals;

an electrode panel seat has a form of a substantially rectangular frame body, a left and a right sides of the frame body being respectively disposed with bent connecting sections, the frame body being disposed with internal transverse beams at equal intervals, a bottom edge of each transverse beam being connected with a perpendicularly projecting electrode panel; and the discharge needle seat and the electrode panel seat are together secured to the drawer body which can be drawn out for washing the discharge needle seat and the electrode panel seat.

2. An electrode panel-drawing device of a static ion discharger as claimed in claim 1, wherein the electrode panel seat and the discharge needle seat are secured to the drawer body with the discharge needles and the electrode panels interlaced with each other.

3. An electrode panel-drawing device of a static ion discharger as claimed in claim 2, wherein the intervals between the electrode panels and the discharge needles are equal to each other.

* * * * *